United States Patent [19]

Tsuboi

[11] Patent Number: 4,589,382

[45] Date of Patent: May 20, 1986

[54] V-TYPE MULTICYLINDER INTERNAL COMBUSTION ENGINE

[75] Inventor: Masaharu Tsuboi, Sayama, Japan

[73] Assignee: Honda Giken Kogyo Kabushiki Kaisha, Tokyo, Japan

[21] Appl. No.: 456,692

[22] Filed: Jan. 10, 1983

[30] Foreign Application Priority Data

Jan. 8, 1982 [JP] Japan ..... 57-1420
Jan. 8, 1982 [JP] Japan ..... 57-1419

[51] Int. Cl.[4] ..... F01L 1/46

[52] U.S. Cl. ..... 123/90.31; 123/55 V; 123/196 R

[58] Field of Search ..... 123/90.27, 90.31, 195 R, 123/55 R, 55 VF, 55 VS, 55 VE, 55 V, 196 R, 2, 56 BA, 56 AA; 184/6.5; 180/230

[56] References Cited

U.S. PATENT DOCUMENTS

| | | | |
|---|---|---|---|
| 2,671,436 | 3/1954 | Pitt et al. | 123/55 R |
| 2,675,791 | 4/1954 | Lundquist | 123/90.31 X |
| 2,831,359 | 4/1958 | Carle | 123/90.31 X |
| 3,418,993 | 12/1968 | Scheiterlein et al. | 123/90.31 X |
| 3,540,420 | 11/1970 | Syson | 123/90.31 X |
| 3,738,338 | 6/1973 | Wickman | 123/90.27 |
| 4,177,689 | 12/1979 | Zeilinger et al. | 123/90.31 |
| 4,230,074 | 10/1980 | Ichikawa et al. | 123/90.27 X |
| 4,395,980 | 8/1983 | Tominaga et al. | 123/90.31 X |

FOREIGN PATENT DOCUMENTS

| | | | |
|---|---|---|---|
| 1550905 | 10/1966 | Fed. Rep. of Germany | 123/90.27 |
| 2914279 | 10/1980 | Fed. Rep. of Germany | 123/2 |

*Primary Examiner*—William R. Cline
*Assistant Examiner*—Peggy A. Neils
*Attorney, Agent, or Firm*—Armstrong, Nikaido, Marmelstein & Kubovcik

[57] ABSTRACT

A V-type multicylinder internal combustion engine having a construction that front and rear cylinder blocks are arrayed in V shape longitudinally of a car body, a longitudinal center line of the rear cylinder block is made offset from the longitudinal center line of the front cylinder block, a crankshaft borne rotatably on a crank and transmission case enclosing a speed change gear therein is coupled to an input shaft of the speed change gear through a primary reduction gear and a clutch, the clutch is disposed on one side of the rear cylinder block, front and rear driving sprockets are mounted on an end of the crankshaft coming on the side isolated from the clutch so that the front driving sprocket comes inside the rear driving sprocket, and front and rear timing chains are laid between the front and rear driving sprockets and front and rear driven sprockets fixed on front and rear valve gear cam shafts provided on front and rear cylinder heads, respectively, which cylinder heads are fixed on the front and rear cylinder blocks through gaskets. With the above arrangement, the parts such as front and rear cylinder blocks, front and rear cylinder heads, front and rear gaskets and front and rear head covers become available for common use to realize reduction in manufacturing cost.

2 Claims, 4 Drawing Figures

V-TYPE MULTICYLINDER INTERNAL COMBUSTION ENGINE

BACKGROUND OF THE INVENTION

1. Field of the Invention

This invention relates to a V-type multicylinder internal combustion engine mounted on small cars such as motor cycle and motor tricycle and, more particularly, to that for which a crankshaft is arranged transversely of a car body, i.e. in the direction orthogonal to the longitudinal direction of the car body.

2. Description of the Prior Art

Conventional internal combustion engines of the mentioned type have such construction that a plurality of cylinder blocks are arranged in a V shape along the longitudinal direction of a car body, and pistons slidably fitted in cylinders formed in the cylinder blocks are rotatably coupled to a crank pin of a crankshaft through connecting rods. However, in the case where the connecting rods are coupled to the common crank pin at their large ends, the front and rear cylinder blocks must be arranged in dislocation from each other axially of the crankshaft at least by the axial length of the large end of each connecting rod.

Then, a crank and transmission case is formed uniformly on the lower ends of cylinder blocks, in which case are accommodated the crankshaft and a speed change gear coupled to the crankshaft by way of a primary reduction gear and a clutch.

Front and rear cylinder heads are fixed on the front and rear cylinder blocks, respectively, through gaskets. Front and rear cam shafts are mounted rotatably on the front and rear cylinder heads, and head covers are fixed thereon through packings. Front and rear timing chains are laid between front and rear driven sprockets fixed to the cam shafts and front and rear driving sprockets fixed to both ends of the crankshaft, respectively, so that the front and rear timing chains are disposed separately on both ends of the crankshaft.

The front cylinder block, front cylinder head, front gasket and front head cover are therefore different in structure from the rear cylinder block, rear cylinder head, rear gasket and rear head cover, respectively, therefore these parts cannot be used in common with each other, and the front and rear driving sprockets on both sides of the crankshaft must be wrought and assembled separately, for which exactly the same precision is hardly obtainable, thus involving a disorder, in most cases, in the operating timing for suction and exhaust valves of the front and rear cylinders actuated on rotations of the front and rear cam shafts.

SUMMARY OF THE INVENTION

Therefore, an object of this invention is to provide a V-type multicylinder internal combustion engine of the kind mentioned above which is capable of removing the above defects unavoidable hitherto.

Another object of this invention is to provide a compact V-type multicylinder internal combustion engine which is obtainable through making the parts such as front and rear cylinder blocks, front and rear cylinder heads, front and rear head gaskets and front and rear head covers available for common use to a decrease in manufacturing cost and also through reducing the engine width, i.e. the overall width of the front and rear cylinder blocks.

Further object of this invention is to make the front and rear driving sprockets ready for working and assembling concurrently by disposing them in parallel both on one side of the crankshaft, thereby securing exactly the same precision therefor.

For the above objects in view, the invention provides a V-type multicylinder internal combustion engine comprising front and rear cylinder blocks arrayed in V shape longitudinally of a car body, front and rear cylinder heads fixed on the cylinder blocks, pistons sliding in the cylinder blocks, a crank and transmission case which is formed uniformly on the cylinder blocks, crankshaft borne rotatably on both side walls of the crank and transmission case at journals on both sides, coupled to the pistons at a crank pin through connecting rods and provided with front and rear driving sprockets, front and rear cam shafts mouned rotatably on the cylinder heads with driven sprockets fixed thereon, a front timing chain laid between the front driving sprocket and the front driven sprockets, a rear timing chain laid between the rear driving sprocket and the rear driven sprockets, and a speed change gear coupled to the crankshafts by way of a primary reduction gear and a clutch; wherein the improvement comprises that the primary reduction gear and the clutch are disposed on one side of the cylinder blocks the rear cylinder block is disposed so that its longitudinal center line is offset in a direction away from said one side relative to a longitudinal center line of the front cylinder block, the front and rear driving sprockets and the front and rear driven sprockets are disposed on an opposite side of the front and rear cylinder blocks to said one side, the rear driving sprocket is disposed outside the front driving sprocket, thereby keeping the front and rear timing chains on the same side and the rear timing chain outside the front timing chain.

In the above configuration, a generator is mounted on an end of the crankshaft which is away from said one side where the clutch is disposed, i.e. on the end adjacent to the opposite side on which the front and rear driving sprockets are mounted, however, the generator appreciably heavy and the timing chains must be supported open-sidedly on a bearing part of the crank and transmission case at the journal of the crankshaft coming near thereto, and particularly the generator is disposed outside the front and rear driving sprockets, therefore an appreciably heavy load is applied on the crank journal, and thus a strength high enough to withstand will be required.

Meanwhile, for lubrication of the crank pin of the crankshaft, a lubricating oil sump is formed axially on the crank pin, the oil sump is kept open to the circumference of the crank pin and connected through to a feed oil passage perforated in the crank journal, the feed oil passage is kept open to the circumference of the crank journal, and thus lubricating oil fed to the bearing is introduced to and lubricates the circumference of the crank pin by way of the oil passage and the oil sump.

Another object of this invention is therefore to provide a V-type multicylinder internal combustion engine of the kind as mentioned hereinabove, which comprises perforating a lubricating oil passage to introduce a lubricating oil, fed to the circumference of the journal of the crankshaft which comes on the side apart from the generator and the front and rear driving sprockets, to an oil sump of the crank pin, thereby keeping the journal of the crankshaft which comes on the side bearing the generator and the front and rear driving sprockets from deteriorating in strength.

The above and other objects, features and advantages of this invention will be apparent from the following description given on a preferred embodiment with reference to the accompanying drawings.

DESCRIPTION OF THE PREFERRED EMBODIMENT

Figure 1:
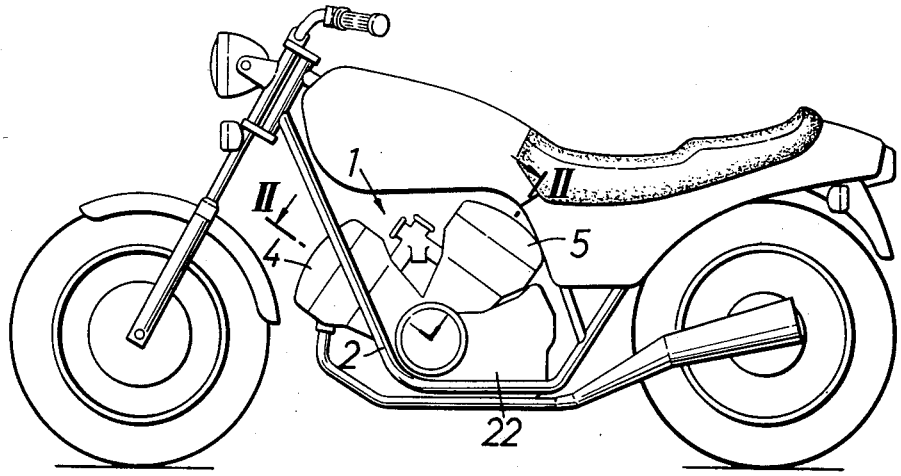
FIG. 1 is a side view of a motor cycle mounted with a V-type multicylinder internal combustion engine according to this invention.

One preferred embodiment of the present invention will be described as follows with reference to the drawings: A motor cycle mounted with a V-type multicylinder internal combustion engine 1 of this invention is shown in FIG. 1.

The V-type multicylinder internal combustion engine 1 is mounted horizontally on a body frame 2 of the motor cycle, i.e. a crankshaft 3 is disposed in the direction orthogonal to the longitudinal direction of the body frame 2, and front and rear engine blocks 4, 5 are disposed across the crankshaft 3 in V shape longitudinally of the body frame 2. The front and rear engine blocks 4, 5 are constituted of front and rear cylinder blocks 8, 9 within which cylinders 6, 7 are formed respectively, front and rear cylinder heads 14, 15 fixed on the top of the cylinder blocks 8, 9 through gaskets 12, 13, front and rear head covers 18, 19 fixed on the top of the cylinder heads 14, 15 through packings 16, 17.

A crank and transmission case 22 is formed uniformly on the bottom of the front and rear engine blocks 4, 5. The crankshaft 3 disposed almost horizontally in the direction across the body frame 2 through an intersection of a longitudinal center line **4*a* of the front engine block 4 and a longitudinal center line 5*a* of the rear engine block 5 is borne rotatably on bearings 23, 24 on both sides of the case 22 at journals 3*a*, 3*b* on both sides thereof. The crankshaft 3 has a common crank pin 3*c* at the center. Two front and rear connecting rods 25, 26 arranged in parallel with each other are borne rotatably on the crank pin 3*c* at their large ends 25*a*, 26*a*, of which the front connecting rod 25 is coupled at its small end to a piston 27 slided in the cylinder 6 of the front cylinder block 8, and the rear connecting rod 26 is coupled to a piston 28 slided in the cylinder 7 of the rear cylinder block 9. Further, the rear engine block 5 is disposed so that its longitudinal center line 5*a* will offset axially toward the journal 3*b* by a center distance $\epsilon$ of the large ends 25*a*, 26*a* of the front and rear connecting rods 25, 26 to the longitudinal center line 4*a* of the front engine block 4**.

Figure 2:
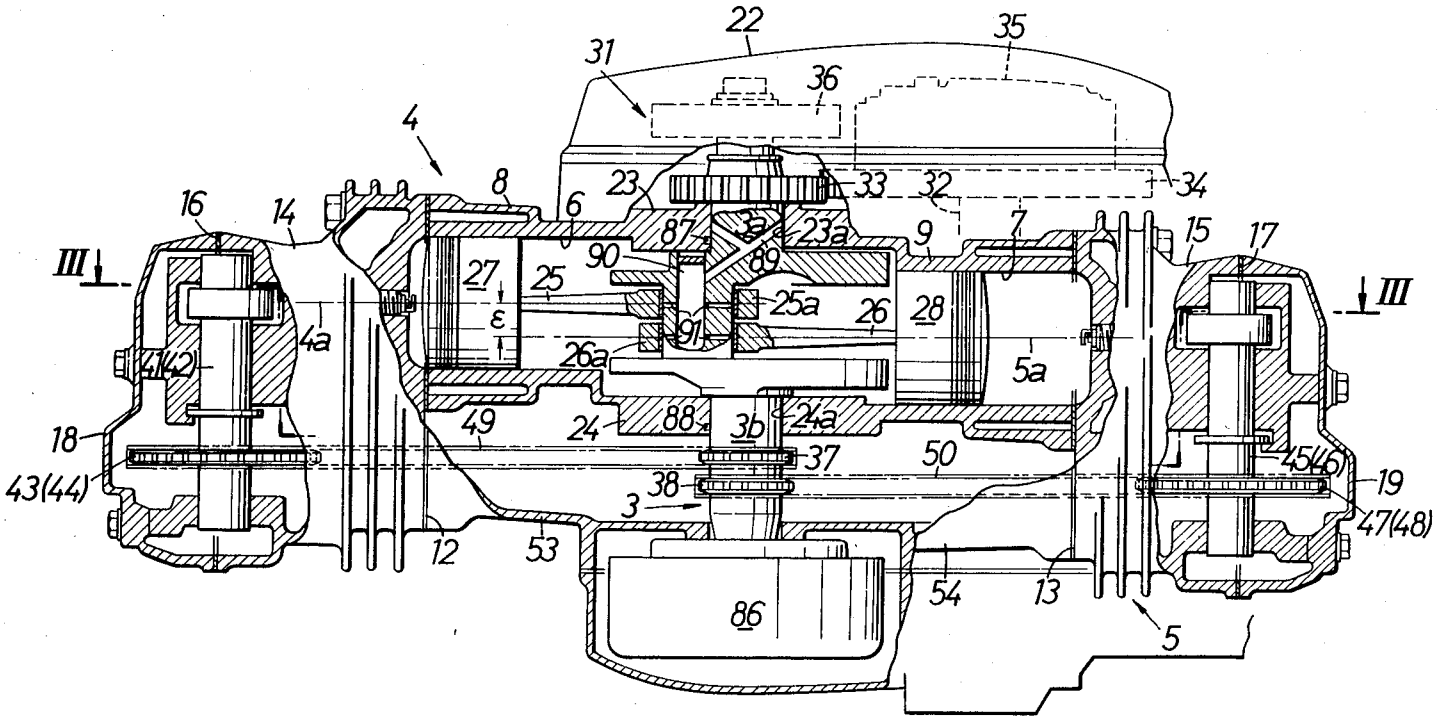
FIG. 2 is a sectional view taken on line II—II of FIG. 1.

As shown in FIG. 2, the crankshaft 3 is coupled at its one end adjacent the journal **3*a* through a primary reduction gear 31 to an input shaft 32 of a speed change gear enclosed in the crank and transmission case 22. The primary reduction gear 31 consists of a primary reduction driving gear 33 fixed on the one end of the crankshaft 3 and a first reduction driven gear 34 coupled to the input shaft 32 through a clutch 35, and a starting gear 36 interlocked with a starter motor (not illustrated) is fixed on a tip end of the crankshaft 3 outside the primary reduction driving gear 33**.

Figure 3:
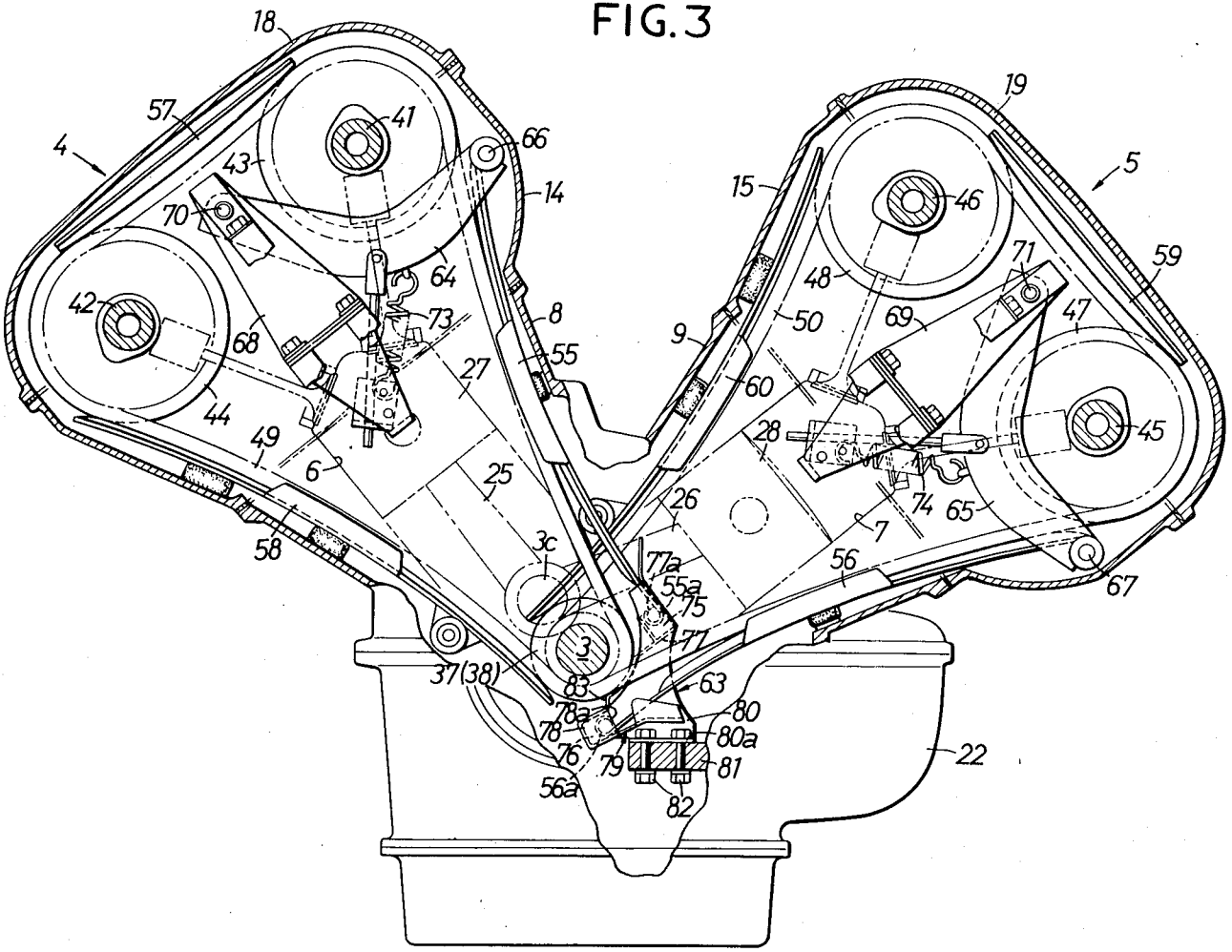
FIG. 3 is a sectional view taken on line III—III of FIG. 2.

An opposite end of the crankshaft 3 adjacent the journal **3*b* and remote from the primary reduction driving gear 33 is projected from the bearing 24 on one side of the crank and transmission case 22, and front and rear driving sprockets 37, 38 are fixed in parallel adjacently to each other on the projection end, the front driving sprocket 37 being disposed inside the rear driving sprocket 38. Then, as shown in FIG. 3, front driven sprockets 43, 44 are fixed on front valve gear cam shafts 41, 42 borne rotatably on the top of the front cylinder head 14 while rear driven sprockets 47, 48 are fixed similarly on rear valve gear cam shafts 45, 46 borne rotatably on the top of the rear cylinder head 15. A front timing chain 49 passes in a space provide sidewardly of the front engine block 4 and is laid around the front driving and driven sprockets 37, 43, 44 and a rear timing chain 50 passes sidewardly of the rear engine blocks 5 and is laid around the rear driving and driven sprockets 38, 47, 48, and thus a turning force of the crankshaft 3 is transferred to the valve gear cam shafts 41, 42; 45, 46**, respectively.

The front and rear timing chains 49, 50 are thus disposed on one side of the front and rear cylinder blocks 8, 9 and covered with chain covers 53, 54 fixed on sides of the cylinder blocks 8, 9 and the cylinder heads 14, 15.

The front driving and driven sprockets 37, 43, 44 and the front timing chain 49 from a front cam driving means. The rear driving and driven sprockets 38,47, 48 and the rear timing chain 50 form a rear cam driving means.

Chain tensioners 55, 56 for giving a tensile force to the portion on delivery side from the driving sprockets 37, 38 of the timing chains 49, 50 are provided inside the chain covers 53, 54 between the front driving sprocket 37 and the front driven sprocket 43 and between the rear driving sprocket 38 and the rear driven sprocket 47, respectively, and chain guides 57, 58; 59, 60 are provided between the front driven sprockets 43, 44, the front driving and driven sprockets 37, 44, the rear driven sprockets 47, 48 and the rear driving and driven sprockets 38, 48, respectively. The chain tensioners 55, 56 have the one ends borne elastically on a common supporting bracket 63 and the other ends coupled pivotally 66, 67 on free ends of bow press members 64, 65. Base ends of the press members 64, 65 are pivoted 70, 71 on brackets 68, 69, respectively, which are mounted on the engine blocks 4, 5, respectively. Press springs 73, 74 are provided between intermediate parts of the press members 64, 65 and the brackets 68, 69, respectively, and the press members 64, 65 are turned in one direction round the pivoted points 70, 71 by a force of the press springs 73, 74 to bend the chain tensioners 55, 56 inside, thereby giving a necessary tensile force to the timing chains 49, 50.

Figure 4:
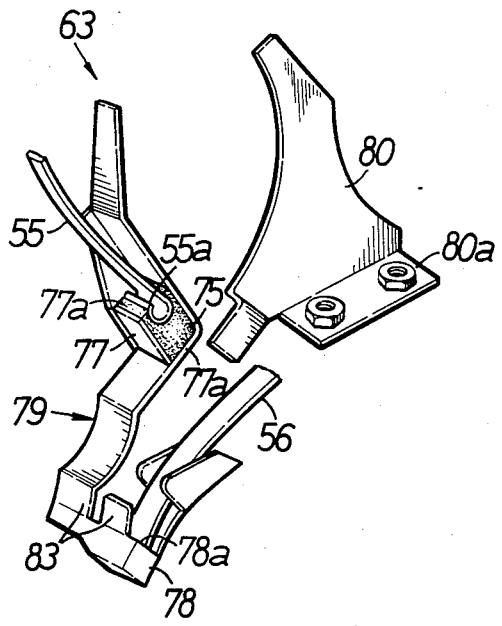
FIG. 4 is an exploded perspective view of a holder of the chain tensioner of FIG. 3.

Meanwhile, as shown in FIG. 4 distinctly, the supporting bracket 63 comprises a frame plate 79 having boxy supports 77, 78 offset axially each other and coupled uniformly, for supporting base ends **55*a*, 56*a* of the chain tensioners 55, 56 elastically through elastic members 75, 76, and a baseplate 80 fixed on an inside edge of the frame plate 79 through welding or other available means to close inside open ends 77*a*, 78*a* of the supports 77, 78. The baseplate 80 has a projection 80*a*** formed uniformly on one side thereof and is fixed at the projection 80*a* on a fitting base 81 provided projectingly inside the crank and transmission case 22 with bolts 82, 82.

Next, the description will refer to a mounting method of the timing chains 49, 50 and the chain tensioners 55, 56; first the timing chains 49, 50 are laid around the down driving sprockets 37, 38, respectively, then the baseplate 80 of the supporting bracket 63 is fixed on the fitting base 81 of the crank and transmission case 22 with the bolts 82, 82, and the timing chains 49, 50 are prevented from coming off the driving sprockets 37, 38 with a retainer 83. The timing chains 49, 50 are laid around the up driven sprockets 43, 44; 47, 48. As described above, the timing chains 49, 50 will not come off the down driving sprockets 37, 38 in this case, thus improving the working efficiency.

After installation of the timing chains 49, 50, the base ends 55*a*, 56*a* of the chain tensioners 55, 56 are inserted in the supports 77, 78 of the supporting bracket 63 together with the elastic members 75, 76 and set at given positions, thus completing the assembly. Therefore, the base ends 55*a*, 56*a* of the chain tensioners 55, 56 can be mounted on the crank and transmission case 22 with the single common supporting bracket 63 so that it is not necessary to mount the base ends 55*a*, 56*a* of the chain tensioners 55, 56 separately on the crank and transmission case 22 with bolts as hitherto, an assembling efficiency is reasonably improved consequently, and further a working space to mount the chain tensioners 55, 56 separately will not be necessary, thereby obtaining a compact engine.

As shown in FIG. 2, a generator 86 is mounted on the tip end of the crankshaft 3 adjacent the journal 3*b* and remote from the primary reduction driving gear 33 outside the rear driving sprocket 38, and hence the comparatively heavy generator 86 and the timing chains 49, 50 are supported open-sidedly by the crank journal 3*b* on the side adjacent thereto.

Lubricating oil grooves 87, 88 open to bearing surfaces 23*a*, 24*a* are formed on the bearings 23, 24 on both sides of the crank and transmission case 22, a lubricating channel 89 open to the sliding surface is formed on the journal 3*a* of the crankshaft 3 on the side isolated from the driving sprockets 37, 38 and the generator 86, which lubricating channel 89 is communicated with an axial oil sump 90 formed in the crank pin 3*c*. A plurality of radial oil passages 91 open to the sliding surface of the crank pin 3*c* is communicated with the oil sump 90 so that a lubricating oil fed to the bearing surface 23*a* by an oil pump (not illustrated) through the oil groove 87 of the one bearing 23 of the crank and transmission case 22 is fed to the oil sump 90 of the crank pin 3*c* by way of the lubricating channel 89 and then lubricates the sliding surface of the crank pin 3*c* through the radial oil passage 91.

Therefore, it is not necessary to form the lubricating channel 89 for feeding the lubricating oil to the oil sump 90 of the crank pin 3*c* on the crank journal 3*b* of the side requiring a comparatively high strength to support the heavy timing chains 49, 50 and the generator 86, and hence a deterioration in strength will not be incurred on the part. It is thus not necessary to increase the strength particularly by preparing a large-sized one for the crankshaft 3 and the crankshaft 3 can be comparatively small-sized to a lightweight structure, thus making the internal combustion engine lightweight and compact as a whole.

What is claimed is:

1. In a V-type multicylinder internal combustion engine for vehicles comprising front and rear cylinder blocks arrayed in V shape longitudinally of a vehicle body, front and rear cylinder heads fixed on each cylinder block, pistons sliding in the cylinder blocks, a crank and transmission case formed uniformly on the cylinder blocks, a crankshaft extending transversely of the vehicle body borne rotatably on both side walls of the crank and transmission case at journals on both sides, said crankshaft being coupled to the pistons at a crank pin through connecting rods and provided with front and rear driving sprockets, front and rear cam shafts mounted rotatably on the cylinder heads with driven sprockets fixed thereon, a front timing chain laid between the front driving sprocket and the front driven sprocket and constituting together with said front driving and driven sprockets a front cam driving means, a rear timing chain laid between the rear driving sprocket and the rear driving sprocket and constituting together with said rear driving and driven sprockets a rear cam driving means, and a speed change gear coupled to the crankshaft by way of a primary reduction gear and a clutch, the front and rear cylinder blocks being so located as to have their longitudinal center lines offset from each other in the transversal direction of the vehicle body, the improvement comprises that the front cylinder block has a longitudinal center line disposed offset relative to a longitudinal center line of the rear cylinder block toward one lateral side of the vehicle body along an axis of the crankshaft, said primary reduction gear and said clutch being disposed on said one lateral side relative to the cylinder blocks, said front and rear cam driving means are disposed on an opposite lateral side of the vehicle body to said one side relative to the cylinder blocks, the offset location of the front cylinder block relative to the rear cylinder block leaving a space on said one lateral side rearwardly of the front cylinder block for mounting of said clutch and leaving another space on said opposite side frontwardly of said rear cylinder block for mounting of said front cam driving means, the rear cam driving means being disposed on that opposite side outside the front cam driving means.

2. A V-type multicylinder internal combustion engine as defined in claim 1 wherein said crankshaft is provided with a generator on an end adjacent said opposite side, the crank pin of the crankshaft has a lubricating oil sump formed therein for communication with the circumference thereof, and the journal of the crankshaft on only said one side has a lubricating channel formed therein for communication with its circumference and also with the lubricating oil sump of said crank pin.

* * * * *